US006978719B2

(12) United States Patent
Sebata et al.

(10) Patent No.: US 6,978,719 B2
(45) Date of Patent: Dec. 27, 2005

(54) RAILWAY CAR AND BOGIE OF RAILWAY CAR

(75) Inventors: Michio Sebata, Kudamatsu (JP); Hideo Takai, Hikari (JP); Terumichi Muramoto, Shunan (JP)

(73) Assignee: Hitachi, Ltd., Tokyo (JP)

( * ) Notice: Subject to any disclaimer, the term of this patent is extended or adjusted under 35 U.S.C. 154(b) by 116 days.

(21) Appl. No.: 10/762,321

(22) Filed: Jan. 23, 2004

(65) Prior Publication Data

US 2005/0087094 A1 Apr. 28, 2005

(30) Foreign Application Priority Data

Oct. 28, 2003 (JP) ..... 2003-366989

(51) Int. Cl.[7] ..... B61F 3/00
(52) U.S. Cl. ..... 105/199.1
(58) Field of Search ..... 105/157.1, 182.1, 105/185, 199.1, 199.4, 200, 238.1, 396, 413

(56) References Cited

U.S. PATENT DOCUMENTS

| | | | | |
|---|---|---|---|---|
| 4,408,541 A | * | 10/1983 | Takai | 105/199.3 |
| 5,222,440 A | | 6/1993 | Schneider | |
| 6,398,047 B1 | * | 6/2002 | Ladendorf et al. | 213/62 R |
| 6,651,567 B2 | * | 11/2003 | Takeichi et al. | 105/329.1 |

FOREIGN PATENT DOCUMENTS

| | | | | |
|---|---|---|---|---|
| EP | 0 469 512 A1 | | 2/1992 | |
| GB | 1101497 | | 1/1968 | |
| JP | 04-173472 | * | 7/1990 | B61F 5/22 |
| JP | 4-201670 | | 7/1992 | |
| JP | 2002-67946 | | 3/2002 | |
| WO | WO 2004/089716 A1 | | 10/2004 | |

OTHER PUBLICATIONS

Partial European Search Report, transmitted Mar. 14, 2005, for EP No. 04250370 (6 pp.).

* cited by examiner

*Primary Examiner*—S. Joseph Morano
*Assistant Examiner*—Robert J. McCarry, Jr.
(74) *Attorney, Agent, or Firm*—Antonelli, Terry, Stout & Kraus, LLP

(57) ABSTRACT

The railway car comprises a subframe 40 disposed below a floor of the car body with a clearance therebetween, and a bogie 30 disposed below the subframe 40 with a clearance therebetween, wherein car body 10 and subframe 40 are connected via a first center pin 50 protruding downward from car body 10 or via a first center pin 50 protruding upward from subframe 40 toward car body 10, and subframe 40 and bogie 30 are connected via a second center pin 70 protruding downward from the subframe 40. A two-step bumper 61 is disposed between the first center pin 50 and the corresponding adjacent member, and two-step bumper 61 is disposed on both sides of center pin 50 in the width direction of car body 10. Car body 10 swings in the width direction when the bogie passes a point. After passing the point, car body 10 returns to its original position by the force of two-step bumper 61.

8 Claims, 6 Drawing Sheets

RAILWAY CAR AND BOGIE OF RAILWAY CAR

FIELD OF THE INVENTION

The present invention relates to a passenger railway car.

DESCRIPTION OF THE RELATED ART

Patent reference document 1 discloses a passenger railway car (rolling stock) having a car body mounted on a bogie, the car body and the bogie being connected via a so-called center pin and connecting link disposed on the bogie. Furthermore, the car body is mounted via an air spring on the bogie. One car body is connected to an adjacent car body via a coupling device. Power is transmitted from the front car body via a coupling device to the following car body, and via another coupling device to the subsequent car body. The coupling device comprises a coupler, a coupling rod, and an elastic member disposed at the center of the coupling device in the traveling direction so as to absorb the shock in that direction. Moreover, this portion is disposed so as to be able to slide with respect to the car body in a vertical movement.

Patent Document 1: Japanese Patent Laid-Open No. 04-173472 The drawbacks of the conventional passenger railway car are noise and uncomfortable ride quality. One cause of the noise is the vibration generated at the bogie which is transmitted to the car body via the center pin.

Further, the elastic member in the coupling device connecting one car body with the adjacent car body is capable of sliding with respect to the car body, and at this portion, the coupling device may collide against the car body by the vertical and horizontal movement of the car body caused by the irregularity of the rail track, which also causes noise and vibration.

According to the conventional railway car, the center pin and the coupler are fixed to the car body 10, so the ends of the car body must have sufficient rigidity. In order to provide sufficient rigidity, a board having considerable thickness is welded onto the floor board. However, such welding operation is not easy since strain is often caused by the process.

SUMMARY OF THE INVENTION

The object of the present invention is to provide an inexpensive car body with low noise.

The object of the present invention can be achieved by a railway car comprising a bogie and a subframe for supporting the car body disposed above the bogie with a clearance between the subframe and the car body, the car body capable of rotating freely in a width direction of the car body with a center of rotation disposed along a longitudinal direction of the car body, wherein either lower surfaces of both width-direction ends of the car body or upper surfaces of both width-direction ends of the subframe are recessed in an arc with the center of the arced surface corresponding to the center of rotation, and either the upper surfaces of the subframe or the lower surfaces of the car body are in contact with the arced surfaces via rollers.

According to this arrangement, the car body can rotate freely with respect to the subframe when needed, and thereafter, such as when the tracks return straight, the car body rotates again with respect to the subframe so that the relative positional relationship between the subframe and car body is returned to its original state.

DETAILED DESCRIPTION OF THE PREFERRED EMBODIMENT

Figure 1:
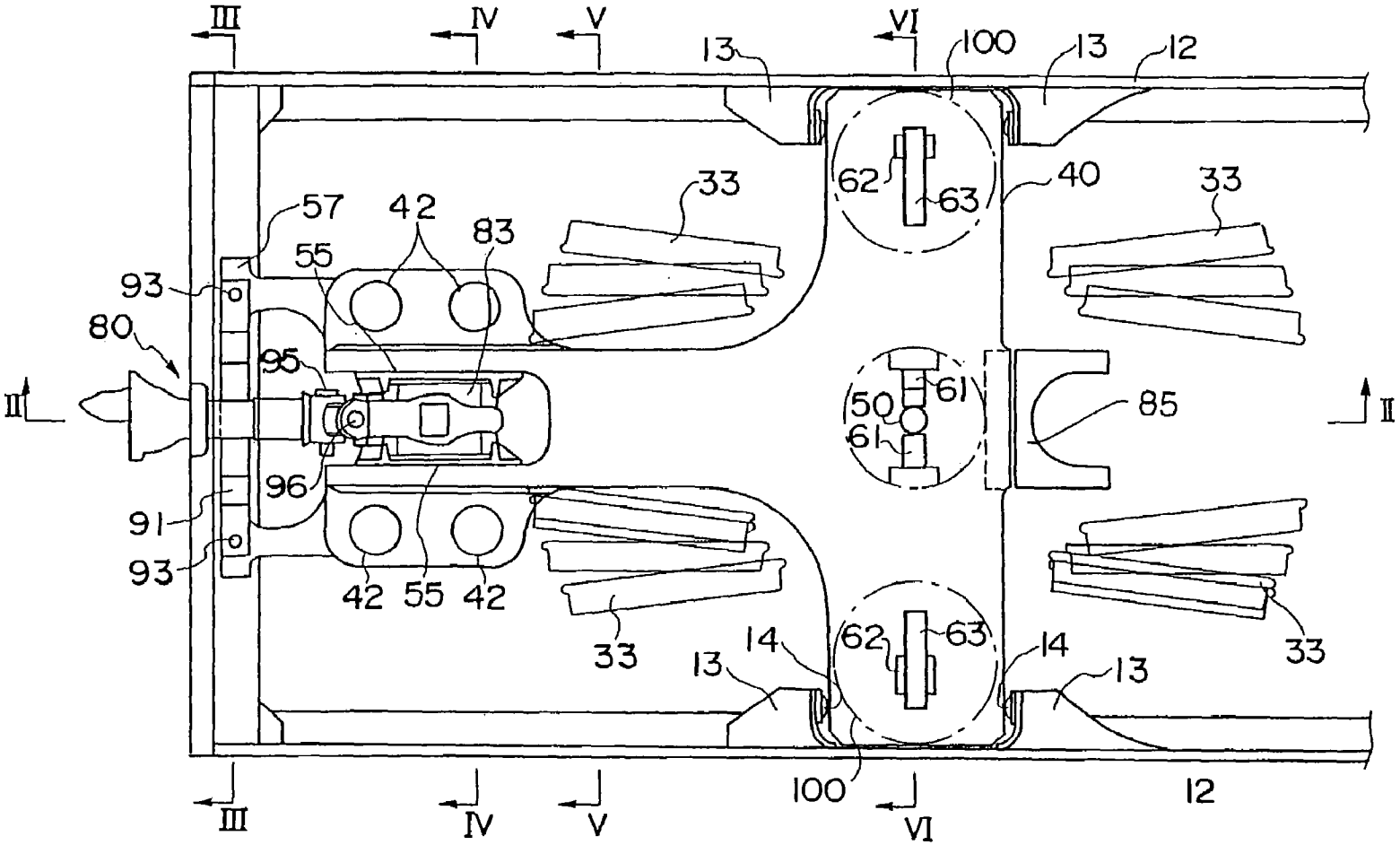
FIG. 1 is a plan view showing one embodiment of the present invention.
Figure 2:
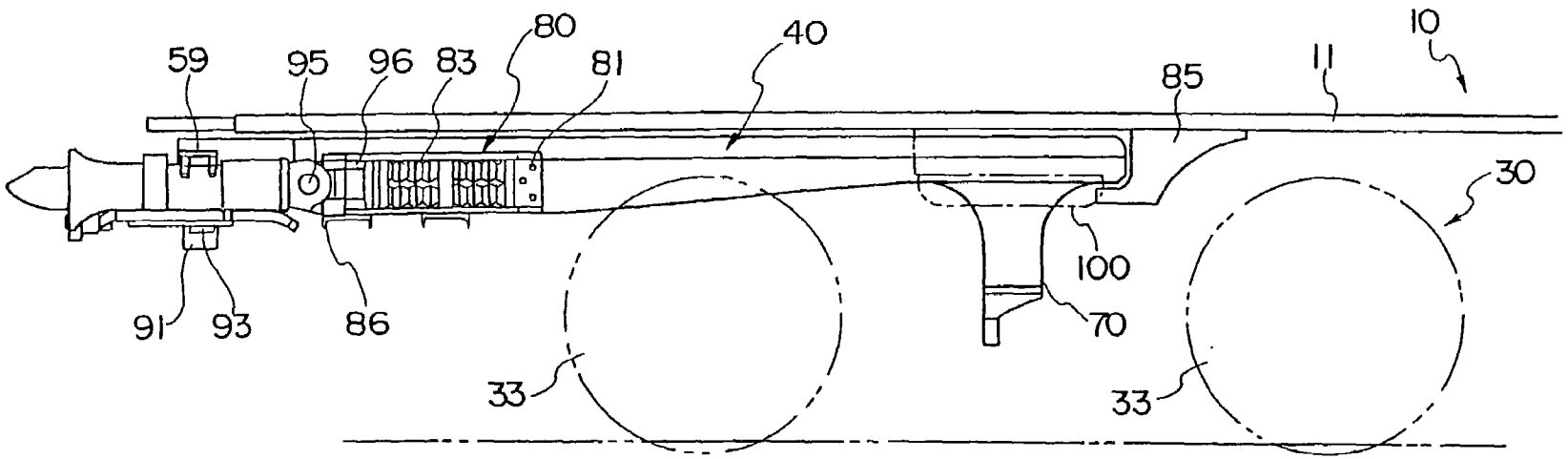
FIG. 2 is a cross-sectional view taken at II—II of FIG. 1.
Figure 3:
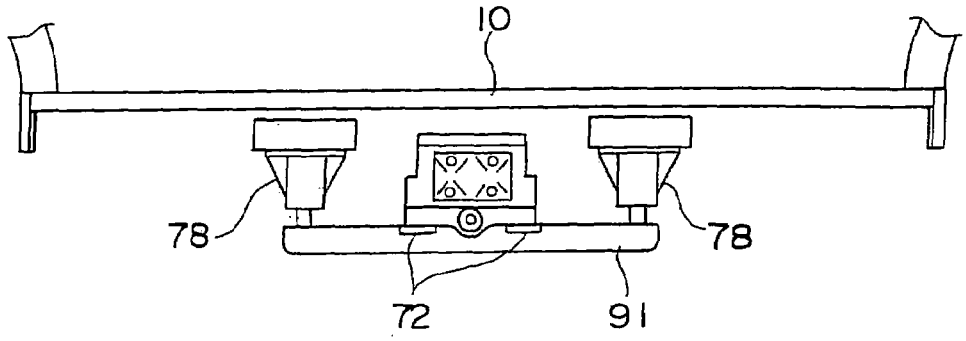
FIG. 3 is a cross-sectional view taken at III—III of FIG. 1.
Figure 4:
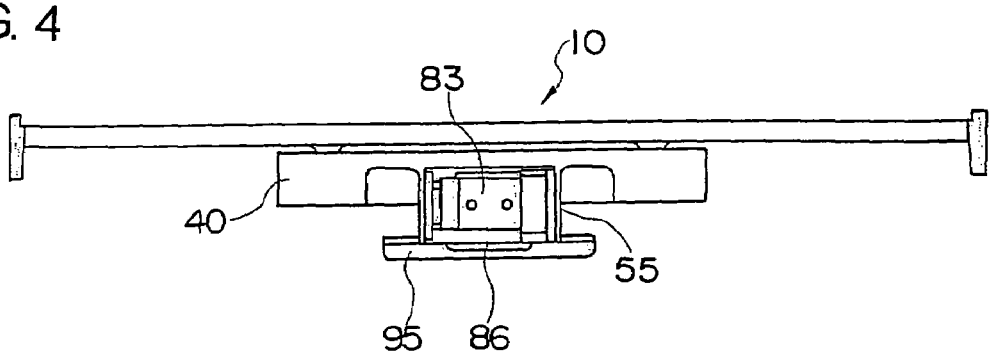
FIG. 4 is a cross-sectional view taken at IV—IV of FIG. 1.
Figure 5:
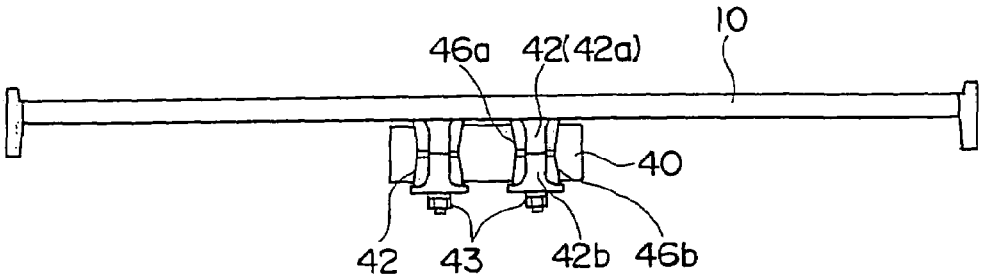
FIG. 5 is a cross-sectional view taken at V—V of FIG. 1.

One preferred embodiment of the present invention will be explained with reference to FIGS. 1 through 9. FIG. 1 is a plan view showing the car body 10 with the floor 11 omitted.

A car body 10 is mounted on a bogie 30 via a subframe 40 at the longitudinal end of the car body. In other words, a subframe 40 is disposed between the car body 10 and the bogie 30. The floor 11 of the car body 10 is formed by arranging long extruded hollow shape members made of aluminum alloy side by side in the width direction of the car body 10 with the length of the members extending in the longitudinal direction of the car body 10, and welding the members together via welding or friction stir welding. The subframe 40 is also made of aluminum alloy.

The subframe 40 is formed of a rigid, thick board, and the inside of the subframe is hollow. The hollow interior of the subframe functions as an air reservoir for an air spring 100.

Figure 6:
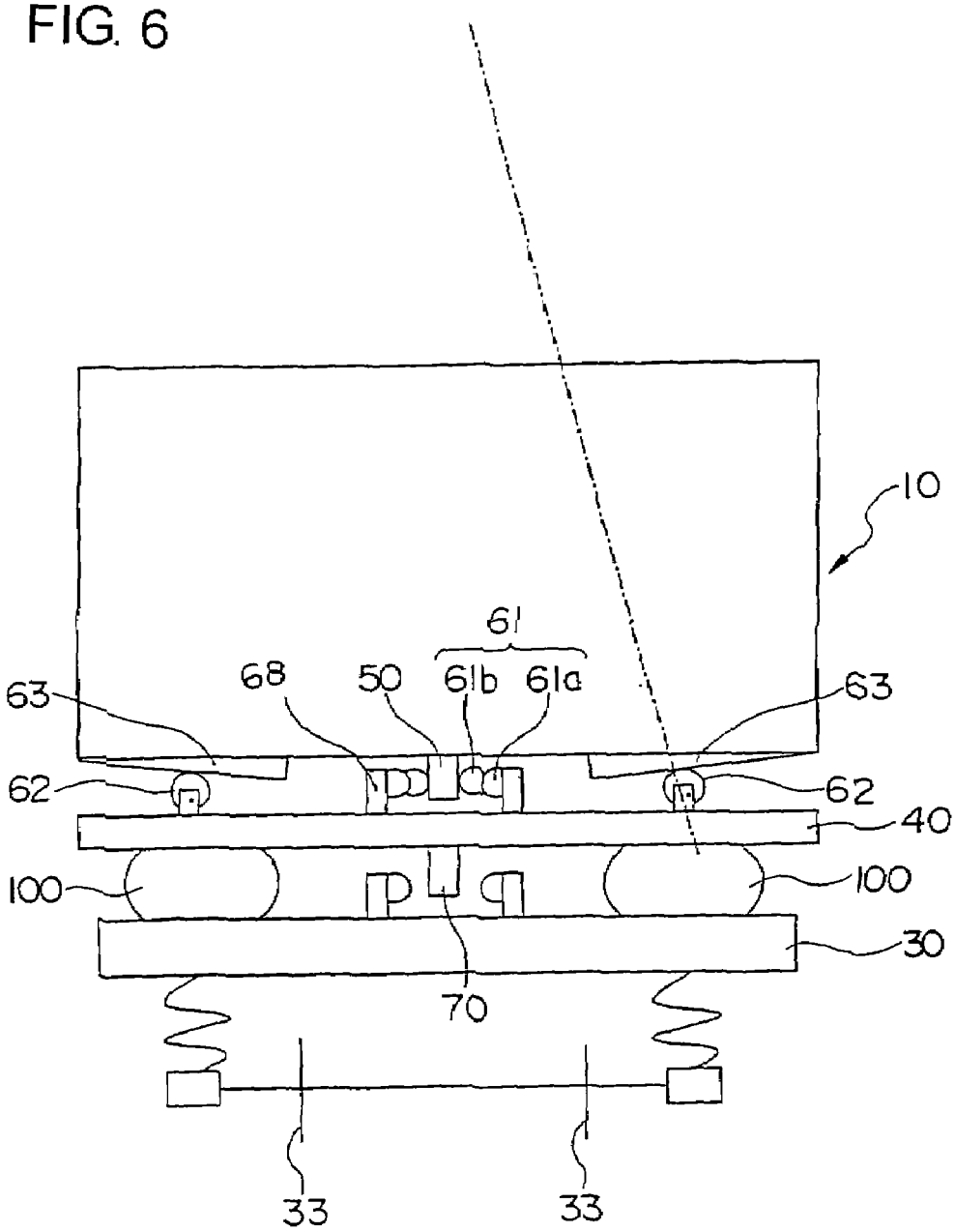
FIG. 6 is a cross-sectional view taken at VI—VI of FIG. 1.
Figure 7:
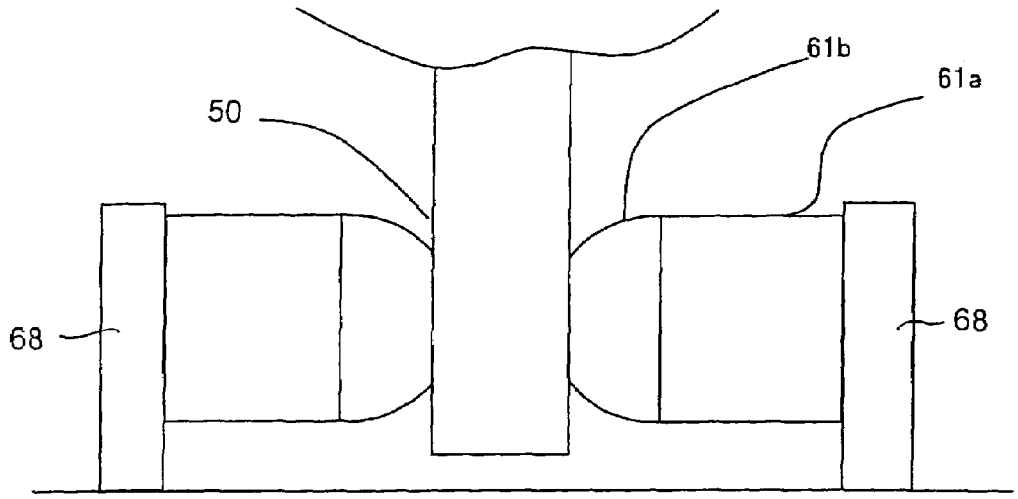
FIG. 7 is a detailed view of FIG. 6.
Figure 8:
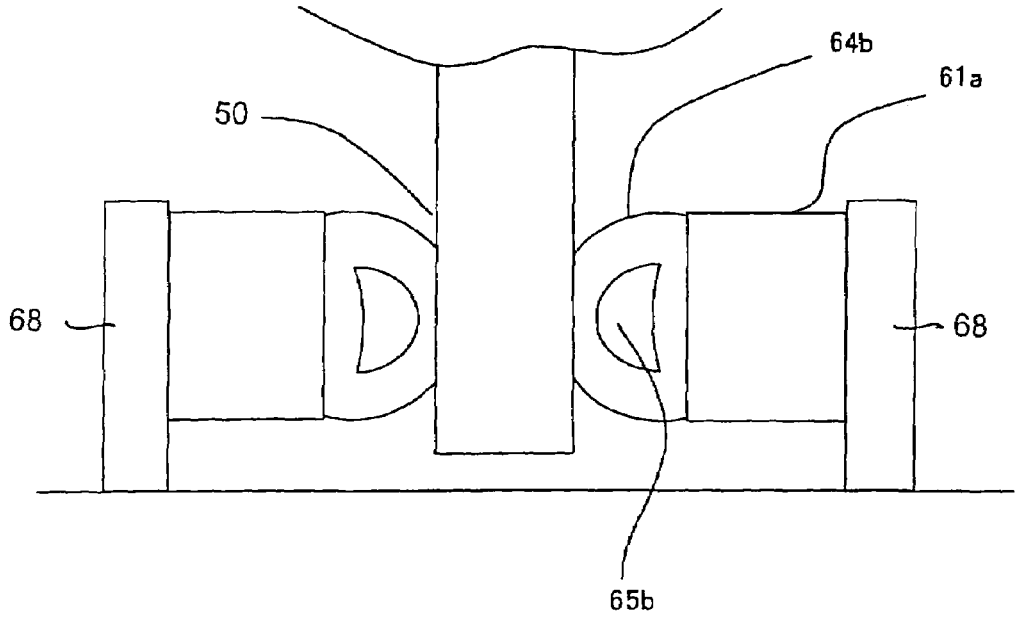
FIG. 8 is another detailed view of FIG. 6.
Figure 9:
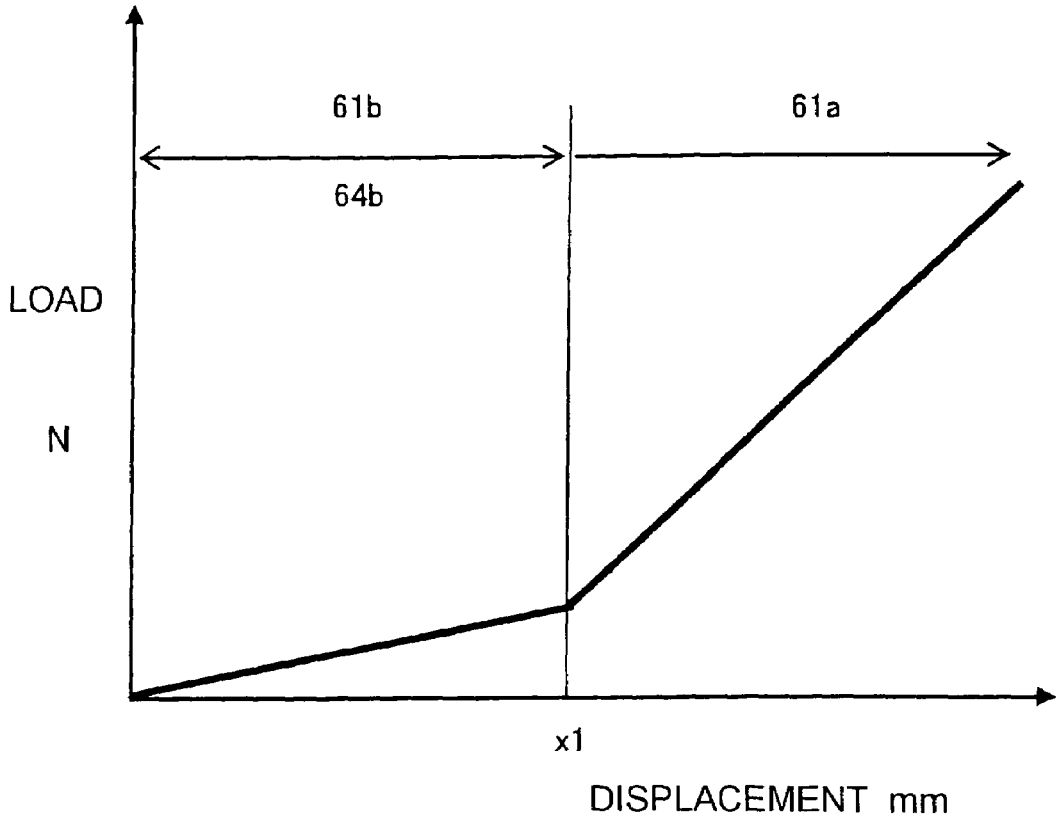
FIG. 9 is a chart showing the flexure of springs shown in FIGS. 7 and 8.

FIGS. 7 through 9 illustrate the structure and characteristics of a bumper. The locomotion of the subframe 40 illustrated in FIG. 6 is transmitted to the car body 10 via a center pin 50 protruding downward from the car body 10. On both sides of the center pin 50 in the width direction of the car body are disposed bumpers 61 made of flexible rubber material. The bumpers 61 shown in FIG. 7 are each fixed to a stopper 68 disposed to protrude from the upper surface of the subframe 40. The bumper 61 is composed of a solid first bumper 61*a* having a large shock absorbing capability, and a second bumper 61*b* disposed on the tip of the first bumper (toward center pin 50) having a smaller shock absorbing capability.

The bumper shown in FIG. 8 is composed of a solid first bumper 61*a*, and a second bumper 64*b* disposed on the tip of the first bumper (toward center pin 50) that is hollow and having a smaller shock absorbing capability. The second bumper 64*b* is disposed instead of the bumper 61*b*, having a hollow portion 65*b* formed in the inside thereof.

FIG. 9 shows the property of the bumper, wherein the vertical axis represents the amount of displacement between the car body and the bogie in the left-right direction and the vertical axis represents the load or pushing force.

According to the second bumper 61*b* or 64*b*, the relationship between the load and the displacement is such that the load is small as shown by the small tilt angle until a certain displacement x1 is reached, and when the displacement exceeds x1, the bumper 61*b* or 64*b* operates and the load is increased as shown by the increase in the tilt angle.

Based on the above, since the second bumper 61*b* or 64*b* is pressed directly against the center pin 50, the spring action of the second bumper 61*b* or 64*b* effectively suppresses the vibration transmitted to the car body from the tracks or from the frame of the bogie. Furthermore, when the displacement in the lateral direction becomes great, the first bumper functions to effectively suppress the displacement in the lateral direction.

For example, when the railway car passes a curve, the second bumper operates softly at first, and when excessive lateral force is received at the curve, the first bumper operates to suppress the displacement. Therefore, sufficient shock absorbing operation can be obtained to correspond to the impact force.

Portions of the bottom surface of a floor of the car body 10 are arc-shaped, and the arced bottom surfaces of the car body 10 are supported by rollers 62. Via the rollers, the car body 10 can be rotated in the width direction with respect to the subframe 40. The arced surfaces are formed only in the areas corresponding to the rollers 62. The arced surfaces are formed by bending a rail 63 into an arc-shape. Since flanges are formed on both ends of the roller in the axial direction that come into contact with the end portions of the rail 63, the rail 63 is prevented from being disengaged from the roller 62.

The subframe 40 is a firm structure formed by bonding relatively thick boards. The subframe 40 comprises a so-called center pin 70 that protrudes downward from the lower surface thereof, the center pin 70 connecting the subframe 40 to the bogie 30 via a link (not shown). The link is disposed along the center of rotation. Further, bumpers 74, 74 are disposed on both width-direction sides of the tip portion of the center pin. Such arrangement is widely known. The term "center pin" is used only because such pins are generally called center pins, and it does not mean that the center pins are disposed at the center of the subframe 40 or bogie 30.

An air spring 100 is disposed between the upper surface of the bogie 30 and the lower surface of the subframe 40. Actually, two air springs 100, 100 are disposed on both sides of the center pin 50. The air-springs 100 are designed and fixed to position in a well known manner.

Moreover, a known coupling rod (coupling device) 80 is connected to the subframe 40 in the horizontal direction. The longitudinal end of the coupling device 80 is connected to the subframe 40 via a pin 81. At the longitudinal center of the coupling device 80 is disposed an elastic draft gear 83, and a guide 55 is disposed on the subframe 40 that allows the vertical movement of the draft gear 83. There is a relatively large clearance (space) between the guide 55 and the draft gear 83. The structure of the draft gear 83 and the guide 55 are well known. The draft gear 83 can be a coil spring or a flexible rubber spring. The relationship between the draft gear 83 and the guide 55 is well known.

The draft gear 83 is connected to the tip of the coupling device 80 via a horizontal pin 85 and a vertical pin 86, the pins allowing the tip of the coupling device 80 to pivot both in the horizontal and vertical directions. Such structure is also well known.

Further, the tip of the coupling device 80 is supported by a receive seat 91 disposed on the subframe 40 via a rubber seat 92. The rubber seat 92 absorbs the shock of contact. A rubber seat 93 is disposed on the subframe 40 that comes into contact with the coupling device 80 when the device 80 jumps up. The receive seat 91 is suspended through elastic members 93.

The middle portion of the coupling device 80 is supported via a receive seat 95 and a rubber seat 96.

The subframe 40 is substantially T-shaped when seen from above. The both side portions of the upper bar of the T (in other words, the areas where the air springs 100 are disposed) are located near the side beams 12 of the car body 10. Stoppers 13, 13 are disposed in front of and at the rear of both side portions of the T with respect to the direction of travel of the car body, and the stoppers 13 are capable of coming into contact with the side portions of the T. The stoppers 13 are fixed firmly to the side surfaces of the side beams 12. The surfaces of the stoppers 13 coming into contact with the subframe 40 are provided with rubber seats 14.

Thereby, the forward and backward power from the coupling device 80 is transmitted via the subframe 40 to the side beams 12 of the car body 10.

As mentioned earlier, known air springs 100, 100 are disposed between the lower surface of both side portions of the T and the upper side of the bogie. Rails 63 and rollers 62 are disposed between the subframe 40 and the floor 11 of the car body 10 at areas above the air springs 100.

According to this arrangement, when the bogie 30 pivots in the width direction of the car body by passing a branch and the like (when the car receives an impact in the width direction of the body), the subframe 40 is pushed in the width direction, and through the bumpers 61 and the center pin 50 the car body 10 is pushed, by which force the car body 10 is rotated.

Thus, the impact by which the bogie 30 is pushed is not directly transmitted to the car body.

When the bogie 30 finishes passing through a point, there will be no more force pressing the car body in the width direction, so the car body 10 returns to its initial state. The rails 63 are rotated on the rollers 62.

Further, the force pushing the bumper 61 and compressing the same is released, so the regaining force of the rubber presses the car body back to its initial position.

Any type of sliding apparatus can be applied to the car body, not only the ones using a round shaft but any apparatus as long as it deforms in a different manner to impact strength in the width direction and that in the longitudinal direction. For example, ring-shaped pipes with different diameters are disposed concentrically, and in the space between the pipes is disposed a rubber member having different elasticity for different directions. The rubber member has rubber disposed only intermittently along the circumference. The rubber member varies its modulus of elasticity between the width direction and the longitudinal direction of the car body by either the positioning of the rubber material or the elasticity thereof. The center axis of the rubber member is fixed to the floor 11 and the subframe 40. Further, a damper plate can be applied. The modulus of elasticity with respect to the longitudinal direction of the car body can be hardened by having stoppers protruding from the car body and from the subframe come into contact with one another.

The bumper 61 has multiple steps of bumpers that correspond to the impact strength in the width direction of the car body, by which the car body can be returned without fail to its original state. That is, when the car body 10 rotates, the center pin 50 comes into contact with the bumper 61. When the rotational force (impact strength) is small, the second bumper 61*b* in the bumper 61 is compressed. When the rotational force (impact strength) is large, the first bumper 61*a* is also compressed. When this rotational force is gone, the car body 10 must return to its original position. With the compression force of the bumper 61 released, the car body 10 receives force pushing it toward its original state. Since the compression of the bumper corresponds to the impact strength, the return force of the car body 10 is substantially fixed.

According to the present embodiment, the coupling device 80 is fixed to the subframe 40, but instead, it can be fixed to the car body.

Furthermore, the center pins 50 and 70 are suspended from above in the example, but they can also be disposed to protrude upward from the subframe 40 and bogie 30.

The width (perpendicular to the longitudinal direction of the car body) of the subframe 40 at the area between the guide 55 and the upper bar of the T is narrowed. At each of the outer sides of this narrowed width portion of the subframe is disposed a circular arc portion of a wheel 33 of the bogie 30 protruding upward. If a wheel is to be positioned at the outer side of the subframe, it is when the wheel 33 is elevated. The wheel 33 is usually located below the outer side of the narrowed width portion of the subframe. There is no subframe 40 disposed above the wheel 33.

Therefore, the distance from the rail (not shown) to the floor surface 11 of the car body 10 can be minimized. In other words, the height of the floor 11 from the rail can be made substantially equal to the floor height of a prior art car body having no subframe. In FIG. 1, the permissible range of movement of the multiple wheels 33 are illustrated.

The coupling device 80 is connected to the subframe 40 and only indirectly connected to the car body 10 via a vibration isolator 40. Therefore, when the railway car passes a branch, the coupling device 80 may bump against the guide 55 generating noise, but little noise is transmitted into the cabin.

Moreover, less noise is transmitted from the bogie 30 through the center pin 70 into the cabin, since the subframe 40 is disposed to the car body with a clearance therebetween. Though the subframe 40 must be rigid, since the subframe 40 and the floor of the car body 10 are separate members and the subframe 40 is not welded onto the car body 10, the floor 11 of the car body 10 can be manufactured relatively easily.

A stopper 95 is disposed at the rear end of the subframe 40 at the center of width thereof. The stopper 95 is welded onto the floor 11, and supports the load of the coupling device 80 via the subframe 40. The stopper 95 has an L-shaped body in cross-section, is in contact with the subframe 40 and supports the downward load thereof. The portion of the floor on which the stopper 95 is disposed is built rigidly.

If the stopper 95 can support the load by itself, the stoppers 13, 13 mentioned earlier are not necessary, and if the stoppers 13, 13 can support the entire load, there is no need to provide the stopper 95.

Since the subframe 40 comes into contact with the side beams 12, the power from the coupling device 80 and the bogie 30 can be transmitted directly to the rigid side beams 12, and thus it becomes possible to simplify the structure of the floor 11 of the car body 10.

Moreover, by mounting apparatuses that generate vibration (such as air compressors, air conditioners and transformers) on the subframe 40 (for example, by suspending them from the subframe), the vibration being transmitted into the cabin can be reduced effectively.

The hollow space inside the subframe 40 can be utilized as a sand reservoir for sanding, or water tank for drinking or for lavatory use.

Furthermore, the space inside the subframe 40 can be utilized as space for mounting damping materials or for filling spherical members for suppressing noise.

Since the size of the subframe 40 is small, it can be manufactured easily using high-strength material that is different from the material used for forming the floor of the car body. The vibration transmitted from the subframe is reduced effectively.

What is claimed is:

1. A railway car comprising:

a car body;

a subframe disposed below a floor of said car body with a clearance therebetween;

a bogie disposed below said subframe with a clearance therebetween; wherein said subframe is capable of traveling in synchronism with said car body in the direction of travel of said car body;

said car body and said subframe are connected via a first center pin protruding downward from said car body or a first center pin protruding upward from said subframe toward said car body;

said subframe and said bogie are connected via a second center pin protruding downward from said subframe or a second center pin protruding upward from said bogie toward said car body;

said car body is capable of rotating freely in a width direction with a center of rotation corresponding to a longitudinal direction of the car body;

either both width-direction ends of a lower surface of said car body or both width-direction ends of an upper surface of said subframe are recessed in an arc-shape with a center corresponding to said center of rotation; and either the upper surface of said subframe or the lower surface of said car body is in contact with said arc-shaped surfaces via rollers.

2. The railway car according to claim 1, wherein a bumper is disposed between said first center pin and a corresponding member in contact therewith.

3. The railway car according to claim 2, wherein said bumper is disposed at both sides of a tip portion of said center pin in the width direction of said car body, said bumper comprising a first bumper that exerts a large shock absorbing power between said center pin and said subframe and a second bumper having a smaller shock absorbing power than said first bumper, said first bumper and said second bumper being disposed serially.

4. The railway car according to claim 2, wherein said first bumper is solid and said second bumper is hollow, and the first and second bumpers are formed integrally.

5. A bogie of a railway car that supports a subframe with a clearance therebetween and the subframe supporting a car body with a clearance therebetween, said railway car comprising:

a subframe disposed below the car body supporting said car body with a clearance therebetween;

a bogie disposed below said subframe with a clearance therebetween; wherein said subframe is capable of traveling in synchronism with said car body in the direction of travel of said car body;

said car body and said subframe are connected via a first center pin protruding downward from said car body or a first center pin protruding upward from said subframe toward said car body;

said subframe and said bogie are connected via a second center pin protruding downward from said subframe or a second center pin protruding upward from said bogie toward said car body;

said car body is capable of rotating freely in a width direction with a center of rotation corresponding to a longitudinal direction of the car body;

either both width-direction ends of a lower surface of said car body or both width-direction ends of an upper surface of said subframe are recessed in an arc-shape with a center corresponding to said center of rotation; and either the upper surface of said subframe or the lower surface of said car body is in contact with said arc-shaped surfaces via rollers.

6. The bogie of a railway car according to claim 5, wherein a bumper is disposed between said first center pin and a corresponding member in contact therewith.

7. The bogie of a railway car according to claim 6, wherein said bumper is disposed at both sides of a tip portion of said center pin in the width direction of said car body, said bumper comprising a first bumper that exerts a large shock absorbing power between said center pin and said subframe and a second bumper having a smaller shock absorbing power than said first bumper, said first bumper and said second bumper being disposed serially.

8. The bogie of a railway car according to claim 6, wherein said first bumper is solid and said second bumper is hollow, and the first and second bumpers are formed integrally.

* * * * *